US010227806B2

(12) United States Patent
Gabl

(10) Patent No.: US 10,227,806 B2
(45) Date of Patent: Mar. 12, 2019

(54) ARRANGEMENT OF A DOOR AND CAVITY FOR AN ARTICLE OF FURNITURE

(71) Applicant: Julius Blum GmbH, Hoechst (AT)

(72) Inventor: Dominik Gabl, Bludenz (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 15/590,661

(22) Filed: May 9, 2017

(65) Prior Publication Data

US 2017/0241178 A1 Aug. 24, 2017

Related U.S. Application Data

(63) Continuation of application No. PCT/AT2015/000141, filed on Nov. 13, 2015.

(30) Foreign Application Priority Data

Nov. 26, 2014 (AT) ..... A 853/2014

(51) Int. Cl.
*E05D 15/58* (2006.01)
*E06B 3/50* (2006.01)
(Continued)

(52) U.S. Cl.
CPC ..... *E05D 15/58* (2013.01); *E06B 3/5045* (2013.01); *E05D 15/264* (2013.01);
(Continued)

(58) Field of Classification Search
CPC ..... E05D 15/58; E05D 15/264; E06B 3/5045; E06B 3/482; E05Y 2900/212; E05Y 2900/14; E05Y 2900/20
(Continued)

(56) References Cited

U.S. PATENT DOCUMENTS 2,337,332 A * 12/1943 Lange ..... F24C 15/02 126/190
3,351,369 A * 11/1967 Hogstrom ..... E05F 1/1008 108/133
(Continued)

FOREIGN PATENT DOCUMENTS

AT 303998 12/1972
CN 101490355 7/2009
(Continued)

OTHER PUBLICATIONS

English translation of Search Report dated Dec. 15, 2017 in Chinese Patent Application No. 201580063984.0.
(Continued)

*Primary Examiner* — Janet M Wilkens
(74) *Attorney, Agent, or Firm* — Wenderoth, Lind & Ponack, L.L.P.

(57) ABSTRACT

An arrangement has a furniture door, in particular a fold-sliding-door, and a chamber-formed cavity for accommodating the furniture door. The arrangement includes a mechanical drive device for moving the furniture door between a countersunk position within the cavity and a position outside of the cavity. The drive device is configured so as to move the furniture door, starting from the countersunk position within the cavity into the position outside of the cavity.

15 Claims, 14 Drawing Sheets

(51) Int. Cl.
*E05D 15/26* (2006.01)
*E06B 3/48* (2006.01)

(52) U.S. Cl.
CPC ..... *E05Y 2900/20* (2013.01); *E05Y 2900/212* (2013.01); *E06B 3/482* (2013.01)

(58) Field of Classification Search
USPC ..... 312/322, 323, 319.1, 319.2
See application file for complete search history.

(56) References Cited

U.S. PATENT DOCUMENTS 4,059,319 A * 11/1977 Hatori ..... G07F 9/10 312/319.1
4,186,972 A * 2/1980 Hagen ..... A47B 88/40 312/110
4,635,763 A * 1/1987 Omata ..... B60N 3/083 131/237
4,821,375 A * 4/1989 Kozon ..... E05D 15/58 16/360
4,974,912 A * 12/1990 Rask ..... E05D 15/58 312/110
5,108,165 A * 4/1992 Rorke ..... A47B 96/00 312/322
5,131,449 A 7/1992 Winn et al.
5,133,433 A * 7/1992 Oosawa ..... F16F 3/10 188/290
6,086,170 A * 7/2000 Chen ..... G11B 33/0472 312/111
7,657,970 B2 * 2/2010 Artsiely ..... E05F 5/02 16/82
8,052,233 B2 * 11/2011 Netzer ..... A47B 95/043 16/85
8,303,056 B2 11/2012 Giorgi
9,057,216 B2 * 6/2015 Bortoluzzi ..... E05D 15/58
9,068,386 B2 6/2015 Ishii et al.
9,894,996 B1 * 2/2018 Grela ..... A47B 96/00
2002/0117946 A1 * 8/2002 Lombardo ..... E06B 3/5045 312/322
2004/0252045 A1 12/2004 Wu
2008/0218043 A1 * 9/2008 Gianelo ..... A47B 43/00 312/319.2
2010/0117500 A1 5/2010 Giorgi
2010/0270898 A1 * 10/2010 Haab ..... E05D 15/0634 312/323
2015/0008811 A1 1/2015 Ishii et al.
2015/0351539 A1 * 12/2015 Baldreich ..... E05D 11/1064 312/319.2
2017/0260789 A1 * 9/2017 Gabl ..... E05D 15/58

FOREIGN PATENT DOCUMENTS

CN 104080992 10/2014
DE 43 08 196 10/1993
DE 298 09 193 10/1998
DE 10 2004 037 1 3/2006
DE 10 2006 008 663 1/2007
EP 0 433 726 6/1991
FR 2511236 * 2/1983
JP 3-123083 12/1991
JP 05-45182 6/1993
JP 6-212854 8/1994
WO 2007/148366 12/2007

OTHER PUBLICATIONS

International Search Report dated Feb. 22, 2016 in International (PCT) Application No. PCT/AT2015/000141.
Search Report dated Sep. 23, 2015 in Austrian Application No. A 853/2014, with English translation.

* cited by examiner

FIG. 2A
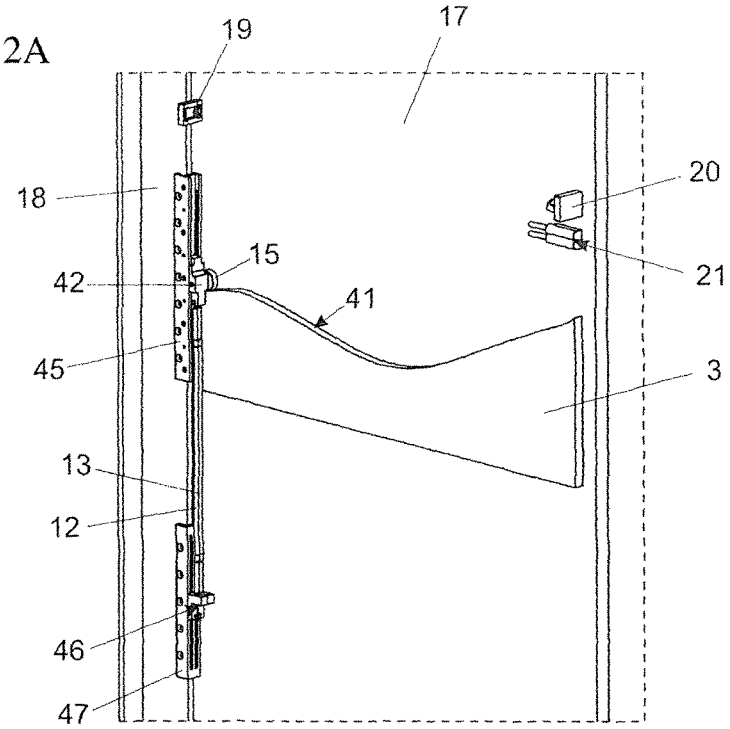
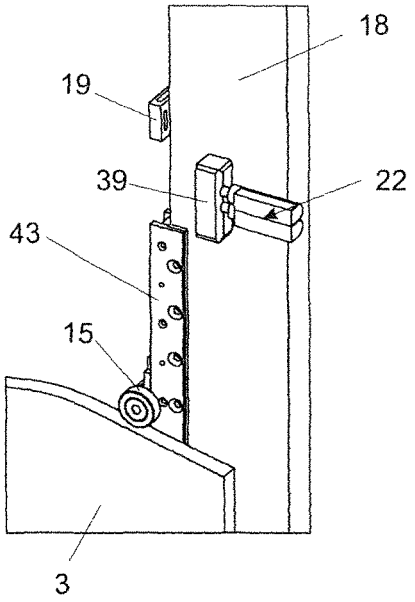
FIG. 2B
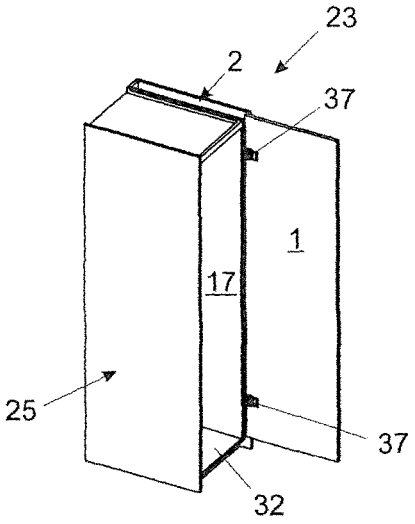
FIG. 2C

FIG. 3A
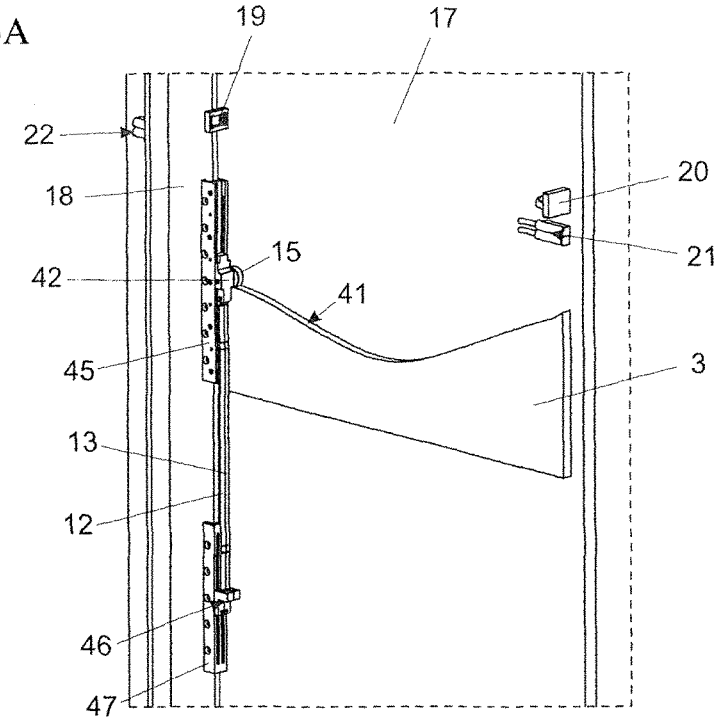
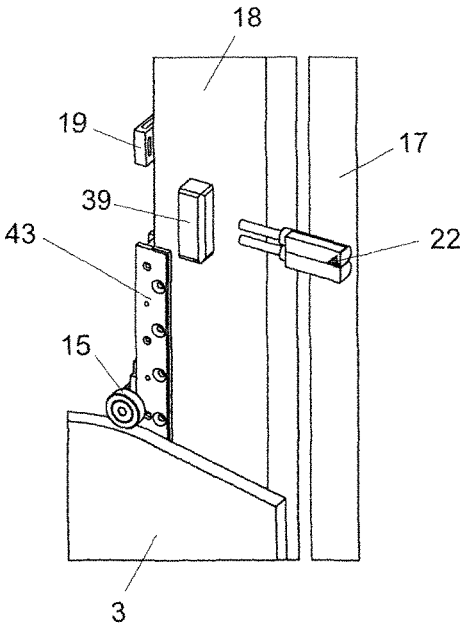
FIG. 3B
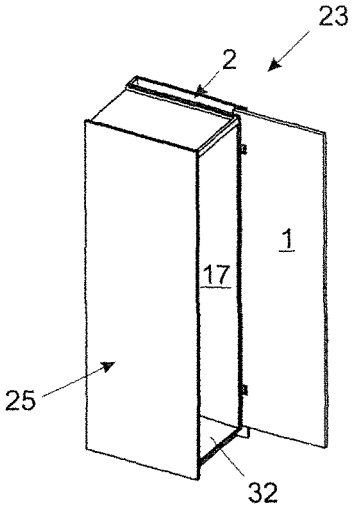
FIG. 3C

FIG. 4A
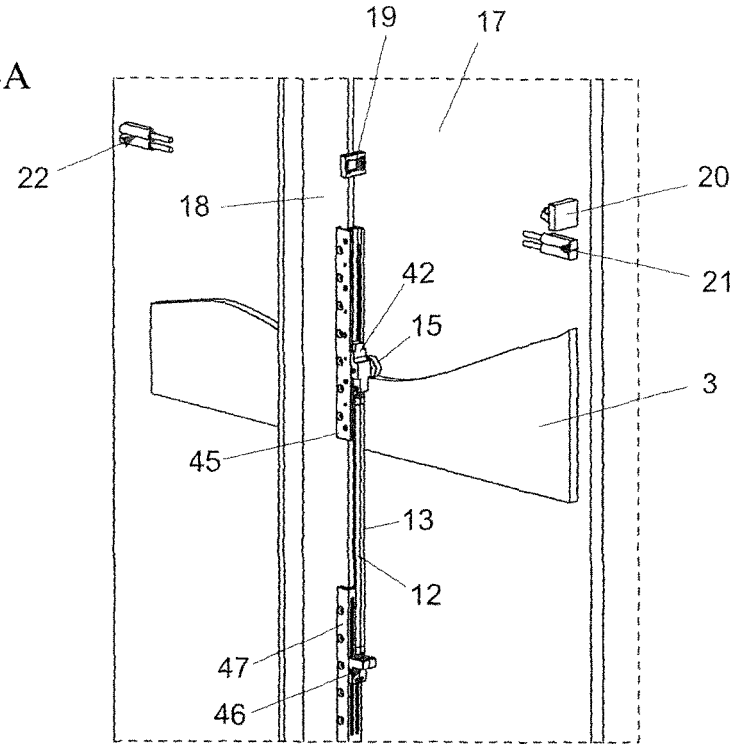
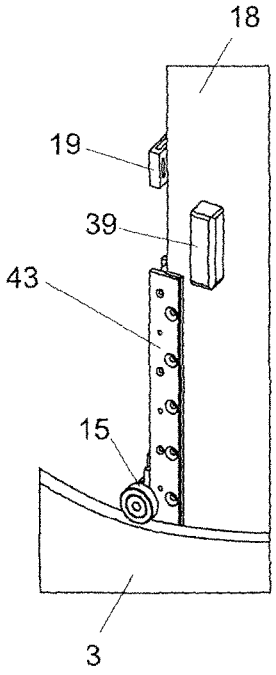
FIG. 4B
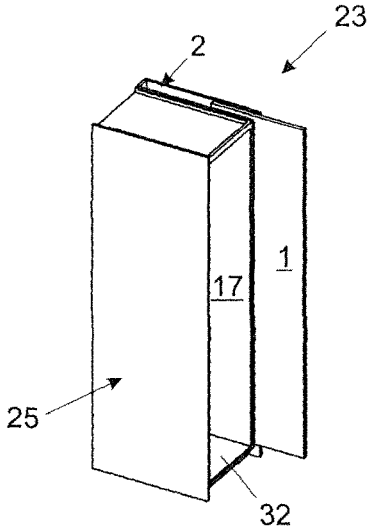
FIG. 4C

FIG. 5A
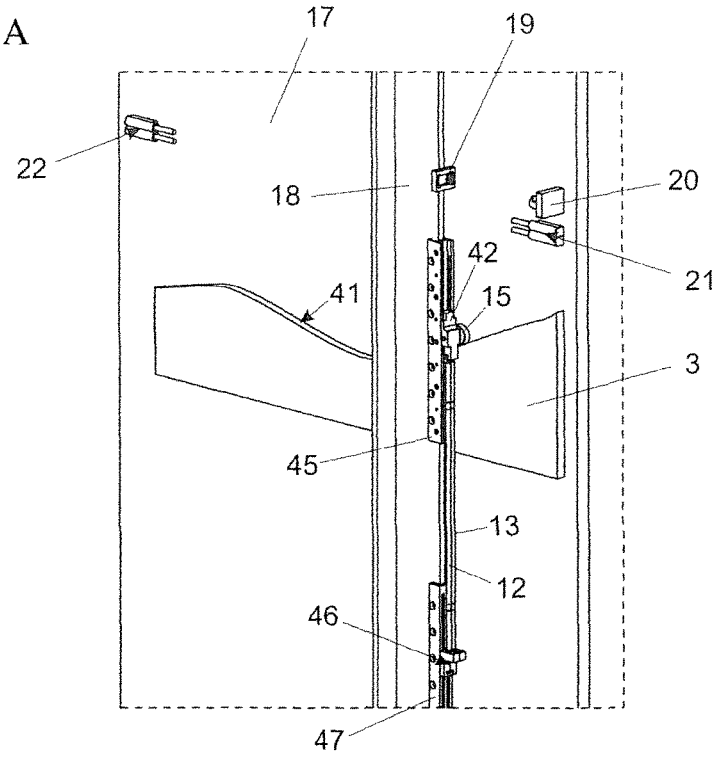
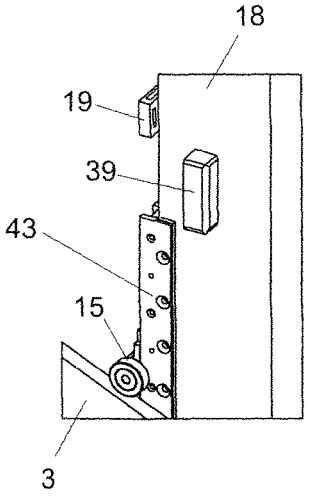
FIG. 5B
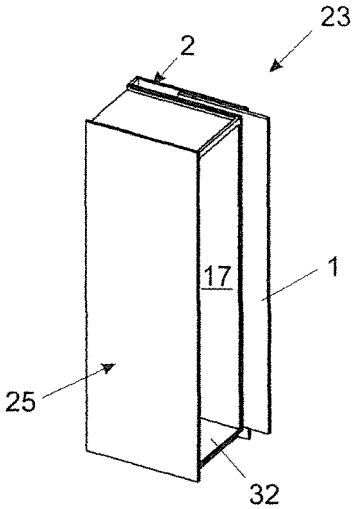
FIG. 5C

FIG. 6A
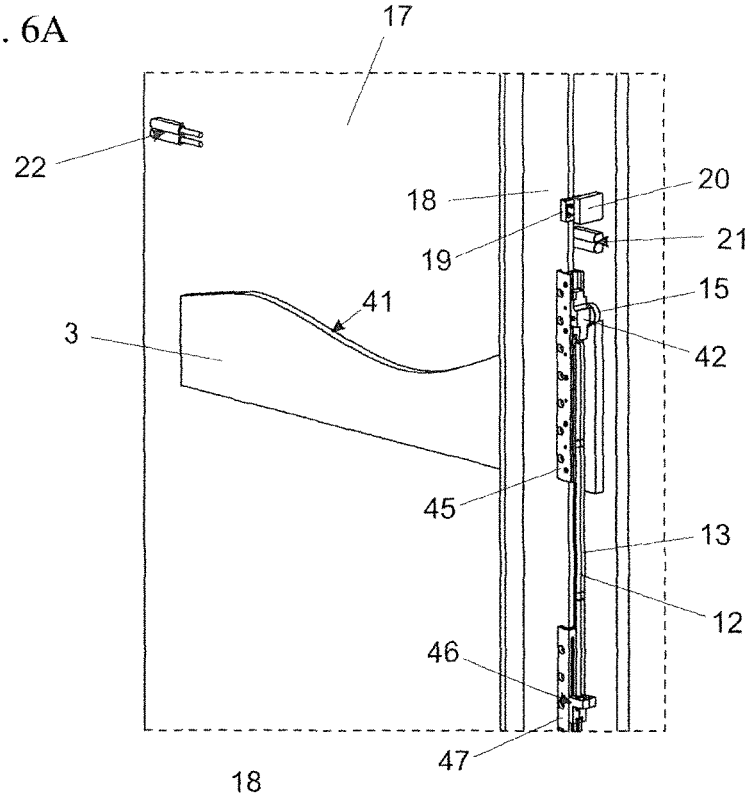
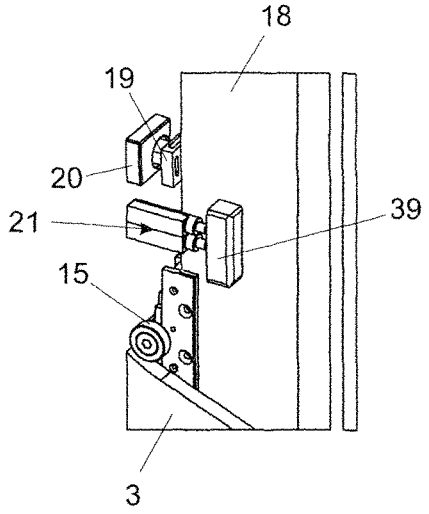
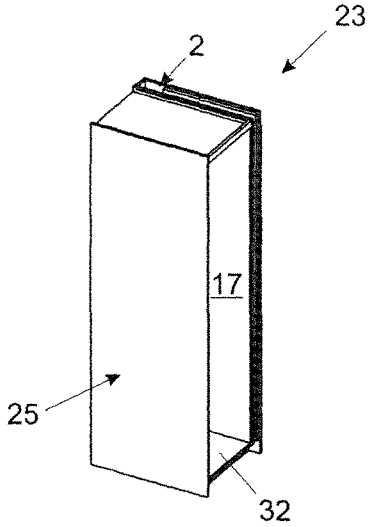
FIG. 6B
FIG. 6C

ARRANGEMENT OF A DOOR AND CAVITY FOR AN ARTICLE OF FURNITURE

BACKGROUND OF THE INVENTION

The invention relates to an arrangement having a furniture door, in particular a fold-sliding door, and a, in particular chamber-formed, cavity for accommodating the furniture door.

Such arrangements are known, for example, from EP 0 433 726 B1 or DE 43 08 196 A1.

A problematic issue with the arrangements according to the state of art is the fact, in particular with heavy furniture doors, for example fold-sliding doors which are composed of a plurality of door wings, that the handling of the furniture doors requires a high physical effort of the operator, in particular in the case when the furniture doors are to be stored within the cavity.

SUMMARY OF THE INVENTION

It is therefore an object of the present invention to provide an improved arrangement with respect to the prior art, thereby avoiding the problems discussed above.

According to the invention, the arrangement includes a mechanical drive device for moving the furniture door between a, preferably fully, countersunk position within the cavity and a position outside of the cavity. In this way, moving the furniture door into the cavity and out of the cavity, respectively, can be significantly facilitated.

Furthermore, the drive device is configured so as to move the furniture door from the, preferably fully, countersunk position within the cavity into the position outside of the cavity. In this case, moving out the furniture door from the cavity is thus effected automatically.

An advantageous embodiment of the invention provides that the furniture door, during the entire movement between the, preferably fully, countersunk position within the cavity and the position outside of the cavity, can be driven by way of the drive device. This means that the drive device is active over the entire distance which the furniture doors covers between the, preferably fully, countersunk position and the position outside of the cavity. This is insofar beneficial because an operator, apart from initiating the movement, needs not to be operative in order to move the furniture door between the positions.

It has further turned out beneficial when the drive device includes a control curve for controlling a movement of the furniture door between the, preferably fully, countersunk position within the cavity and the position outside of the cavity. The provision of such a control curve has the advantage that the drive force exerted by the drive device can be transmitted to the furniture door according to a predetermined movement pattern in a metered manner. In this way, particularly harmonic movement sequences can be realized, for example in such a way that the furniture door can initially be driven, starting from the, preferably fully, countersunk position within the cavity with a high force and is then being braked and eventually reaches the position outside of the cavity with less speed. In this way, injuries of persons near the cavity as well as damages of a possible damping device for dampening the movement of the furniture door immediately before reaching the position outside of the cavity are prevented.

An advantageous development of this embodiment lies in the fact that the control curve can be adapted to different depths of the cavity, and the control curve, for this purpose, is composed of at least two segments which are adjustable relative to one another. In this case, the same control curve can always be used for cavities having a different depth, whereby the manufacturing costs can be reduced.

Alternatively or additionally, the drive device includes an energy storage member, preferably in the form of at least one tension spring, and a control element which is acted upon by the energy storage member and which rests against the control curve with the force of the energy storage member, wherein the control element is preferably in the form of a roller.

Therefore, the control curve can be stationarily arranged relative on the furniture door, preferably on a limiting surface of the cavity, and that the control element which is acted upon by the energy storage member can be coupled to the furniture door, preferably by way of a base fastening element of the furniture door, or vice versa.

Further, two basic compositions are possible in such a way that the control element, in the mounting position of the drive device, is supported on the upper side or on the lower side of the control curve.

It has also turned out to be beneficial when the control element, in the mounting position of the drive device and when the furniture door is arranged in the, preferably fully, countersunk position, assumes the highest point or the lowest point of the control curve.

Beneficial developments of the invention lie in the fact that the drive device, when the furniture door is arranged in the, preferably fully, countersunk position within the cavity, exerts a driving force to the furniture door, and/or the drive device, when the furniture door is arranged outside of the cavity, exerts a restraining force to the furniture door. In the first case, the furniture door, when being located in the, preferably fully, countersunk position within the cavity, can be moved out of the cavity very easily. In the second case, an unintentional pushing-in movement into the cavity at an early stage can be prevented.

In addition, the arrangement can include a locking device for releasably locking the furniture door in the preferably fully, countersunk position within the cavity, and the locking device can be unlocked, preferably by overpressing the furniture door into an overpressing position which lies behind the, preferably fully, countersunk position. Such locking devices are basically known in the state of art, however not in conjunction with the releasable locking of a furniture door within a cavity. The provision of such a locking device is, in particular, advantageous when the furniture door is to be safely stored within the cavity and the drive device exerts at least a driving force in a direction towards the position outside of the cavity.

When the furniture door includes at least two door wings which are connected to one another and which can assume a folded position and a spreaded position, it is beneficial when the arrangement includes a spreading device for spreading apart the at least two door wings from the folded position into the spreaded position. In this way, for example, a motion sequence can be realized so that the furniture door is located in its folded condition in the, preferably fully, countersunk position within the cavity. In this case, the drive device moves the furniture door out of the cavity and is then moved out of the cavity by the drive device and, subsequently, the spreading device becomes operative, so that an operator—in order to swivel the at least two door wings completely open, i.e. to move the two door wings in a position in which the door wings are located in a common plane or in planes being parallel to one another—needs to solely apply a small force to the spreaded door wings in the region of the bend, provided that the door wings are supported on a rail system or the like.

A beneficial movement sequence can be realized in such a way that the arrangement includes a damping device for dampening the movement of the furniture door immediately before reaching the, preferably fully, countersunk position within the cavity and/or a damping device for dampening the movement of the furniture door immediately before reaching the position outside of the cavity.

Ideally, the arrangement eventually includes an item of furniture, preferably a cupboard, having a furniture carcass, wherein the cavity is formed in the furniture carcass, preferably in an edge region, and that the item of furniture can be closed by way of the furniture door.

Protection is also sought for a drive device for an arrangement according to the invention.

BRIEF DESCRIPTION OF THE DRAWINGS

Further advantages and details of the invention result with reference to the drawings, in which:

FIG. 2*a* through FIG. 6*c* illustrate storage of the furniture door within the cavity, wherein FIGS. 2*a*, 3*a*, 4*a*, 5*a*, and 6*a* each show substantial components of the drive device seen from the rear wall of the cabinet, FIGS. 2*b*, 3*b*, 4*b*, 5*b*, and 6*b* each show a section of the drive device seen from the front side of the item of furniture, and FIGS. 2*c*, 3*c*, 4*c*, 5*c*, and 6*c* each show the item of furniture in its entirety;

FIGS. 7*a* through 7*e* show the opposing motion sequence, starting from the countersunk position within the cabinet towards the position outside of the cavity is schematically depicted;

FIG. 9*a* through FIG. 11*b* show the storing of a furniture door within the cavity according to a second embodiment, wherein FIG. 9*a* shows a perspective view of a section of the item of furniture, FIGS. 9*c*, 10*d*, and 11*b* show the substantial components of the drive device in an enlarged view;

DETAILED DESCRIPTION OF THE INVENTION

Figure 1:
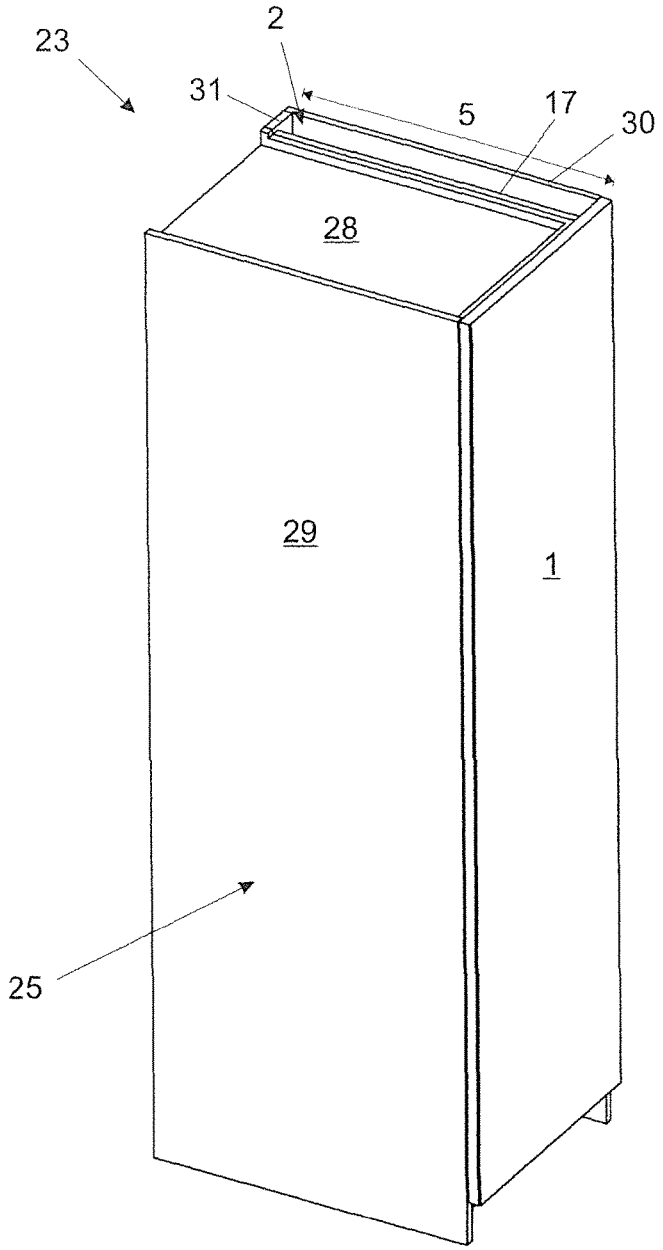
FIG. 1 shows a cabinet.

In particular, FIG. 1 shows a first item of furniture 23 in the form of a cupboard which includes a furniture carcass (furniture body) 25 which is composed of a multiple of side walls 29, 17 and 30 which are arranged in parallel relationship relative to one another, a rear wall which includes a partial section 31, the cover plate 28 and a base plate 32 (see FIG. 2*c* for example), and a furniture door 1 by way of which the item of furniture 23 can be closed. The side walls 17 and 30 being spaced from one another and the partial section 31 of the rear wall represent limiting surfaces for defining a chamber-formed cavity 2 of the furniture body 25. The width of the side walls 17 and 30 and the cupboard 23, respectively, define the depth 5 of the cavity 2.

The furniture door 1 is fastened to a base fastening element 18 by hinges 37, wherein the base fastening element 18, as shown in the following figures, is operatively connected to the drive device.

Figure 8:
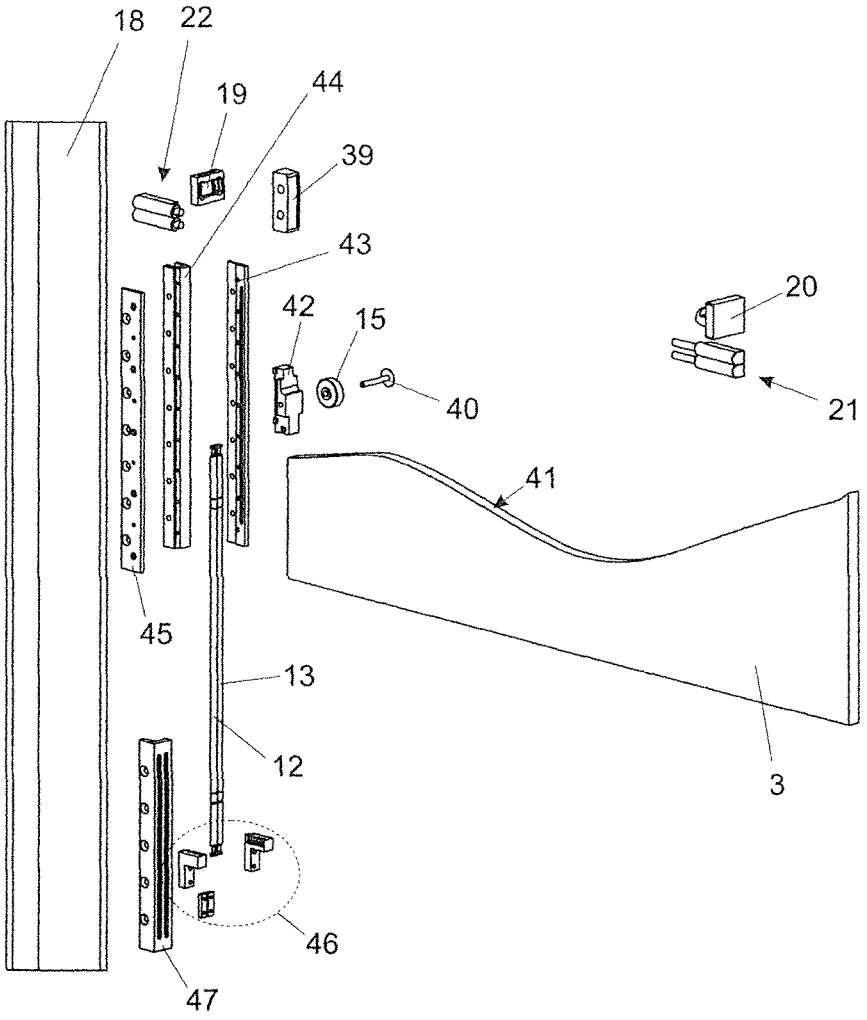
FIG. 8 shows an exploded view of the drive device according to the first embodiment.

As shown in particular in the exploded view according to FIG. 8, the drive device includes substantially the following components: A control curve 3 having an upper side 41, wherein the control curve 3, in the present case, is attached to a side surface 17 of the furniture carcass 25, i.e. on a limiting surface of the cavity 2. In the mounting position of the drive device, the control element 15 in the form of a roller is supported on the upper side 41 of the control curve 3, wherein the roller is mounted via a bolt 40 on a slider 42. The slider 42, for its part, is linearly displaceably mounted in a guide which is composed of the two guide elements 43, 45 and the support element 44 by which also the attachment of the slider guide on the base fastening element 18 for the furniture door 1 is affected. The slider 42 and therewith the control element 15 is acted upon by an energy storage member in the form of two tension springs 12 and 13, wherein a first end of these tension springs 12 and 13 is each connected to the slider 42 and a second end is each held by a spring tensioner 46. The spring tensioner 46 is adjustably arranged on a support element 47. By way of an adjustment of the spring tensioner 46 on the support element 47, different spring forces can be adjusted.

The sequence according to FIG. 2 through 6 assumes that an operator would like to store the furniture door 1 within the cavity 2 upon opening the furniture door 1.

FIG. 2*c*) shows the respective position of the furniture door 1 outside of the cavity 2. In this position, the drive device exerts a restraining force to the furniture door 1, because the control element 15, in a direction of the fully countersunk position within the cavity 2, is exposed to an ascending slope of the control curve 3 and the tension springs 12 and 13, in this condition, have a slight prestressing and therefore have the tendency to retract to one another. This means that an operator needs to initially overcome the restraining force of the drive device in order to move the furniture door 1 into the cavity 2. The restraining force, which needs to be overcome in an intentional manner, prevents the furniture door 1 from being moved into the cavity at an early stage, for example when the furniture door 1 is not yet fully opened. i.e. not yet entirely aligned in the plane of the longitudinal extension of the cavity 2.

Upon the transition from the position which is shown in FIG. 2, and the position shown in FIG. 3, the control element 15 is guided upwardly along the ascending slope of control curve 3 and therewith the energy storage member is slightly loaded.

After the local maximum of the control curve 3 has been overcome, the control element 15 moves towards the direction of a minimum which is reached when arriving the position shown in FIG. 4.

Upon the transition starting from the position shown in FIG. 3 and the position according to FIG. 4, the energy which is stored in the energy storage member is being released and thereby supports the acceleration of the base fastening element 18 and therewith of the furniture door 1. In this way, the pushing-in movement of the furniture door 1 into the cavity 2 is facilitated.

In the position according to FIG. 4, the tension springs 12 and 13 of the energy storage member are tensioned to its lowest extent. By their inertia, the furniture door 1 is further moved towards the following charging operation of the energy storage member, wherein the charging operation is finished when reaching the fully countersunk position within the cavity (see FIG. 6). FIG. 5 thereby shows an intermediate position.

When reaching the fully countersunk position within the cavity 2 (see FIG. 6), locking of the furniture door 1 is effected on the one hand in order to prevent the furniture door 1, under the influence of the loaded energy storage member, from immediately being pushed out of the cavity 2. For the realization of the locking, the arrangement includes a locking device which is formed of a first locking unit 19 being arranged on the base fastening element 18 and a second locking unit 20 cooperating therewith, the second locking unit 20 being arranged on the carcass side.

In order to achieve a smooth arriving of the fully countersunk position within the cavity 2, the arrangement further includes a damping device 21 for dampening the movement of the furniture door 1, and the damping device 21 cooperates with a stop 39 being arranged on the base fastening element 18.

It is further to be noted that the ascending slope which the control element 15 encounters upon the transition according to FIG. 4 into the position according to FIG. 6 is configured such that an operator, at a natural speed which takes place due to the inertia of the furniture door 1, only feels a slight resistance.

Figures 7A, 7C, 7E:
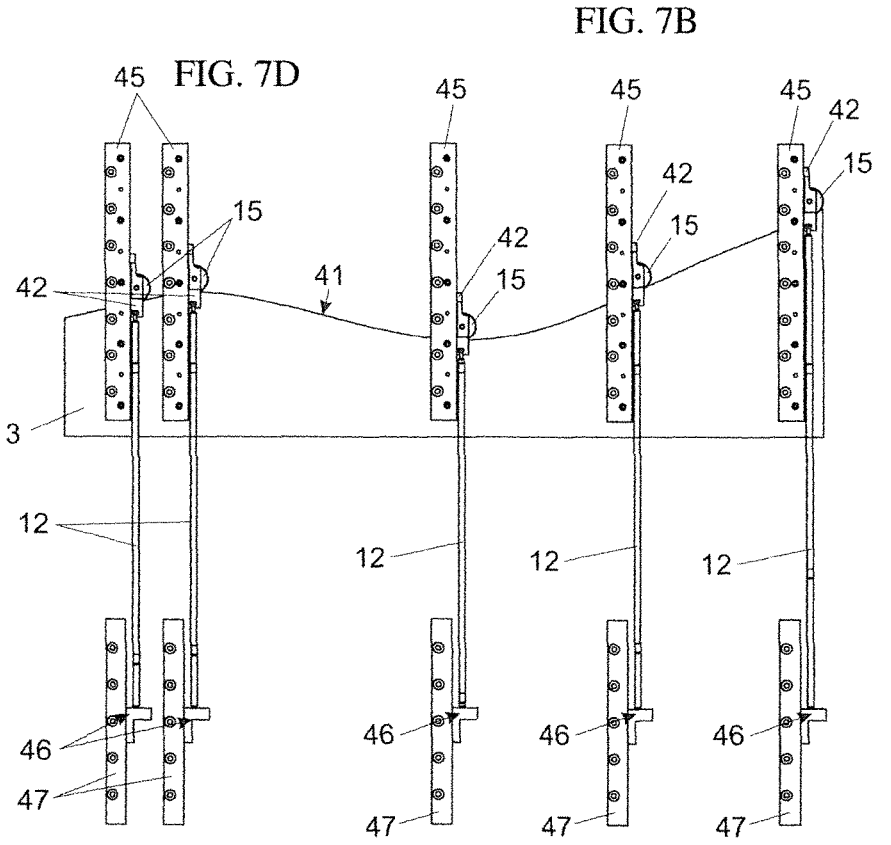

FIG. 7*a*) through 7*e*) show the opposing movement sequence, i.e. the movement of the furniture door 1 starting from the fully countersunk position within the cavity 2 towards the position outside of the cavity 2. This movement is initiated by overpressing the furniture door 1 into an overpressing position which lies behind the fully countersunk position. In this way, the locking device 19, 20 is being unlocked. The energy which is stored in the energy storage member is transmitted to the base fastening element 18, to which the furniture door 1 is hingedly connected, and accelerates the latter in an outward direction. The slope of the control curve 3 is thereby chosen in such a way that the acceleration is very high at the beginning. In this way, a dynamic reaction of the system can be simulated.

During the acceleration phase (see FIG. 7*b*), no engagement of an operator is necessary and when reaching the minimum of the control curve 3, the furniture door 1 has reached its maximum ejection speed and the braking operation is being initiated. The braking operation is necessary in order to reduce the speed of the system when reaching the position outside of the cavity 2. This prevents, on the one hand, a damage of the damping device 22 for damping the movement of the furniture door 1 immediately before reaching the position outside of the cavity 2 and, one the other hand, an injury of the operator which is in the region of the cavity 2.

When reaching the position according to FIG. 7*d*), the braking operation is finished and the damping device 22 becomes operative.

In FIG. 7*e*), the initial position according to FIG. 2 is reached. The furniture drive 1 can now be closed by the operator.

With reference to FIG. 9 through 13, the second embodiment will now be described which differs from the first embodiment substantially in that the control curve can be adapted to different depths of the cavity, wherein the control curve, for this purpose, is composed of at least two segments which are adjustable relative to one another.

Figure 9A:
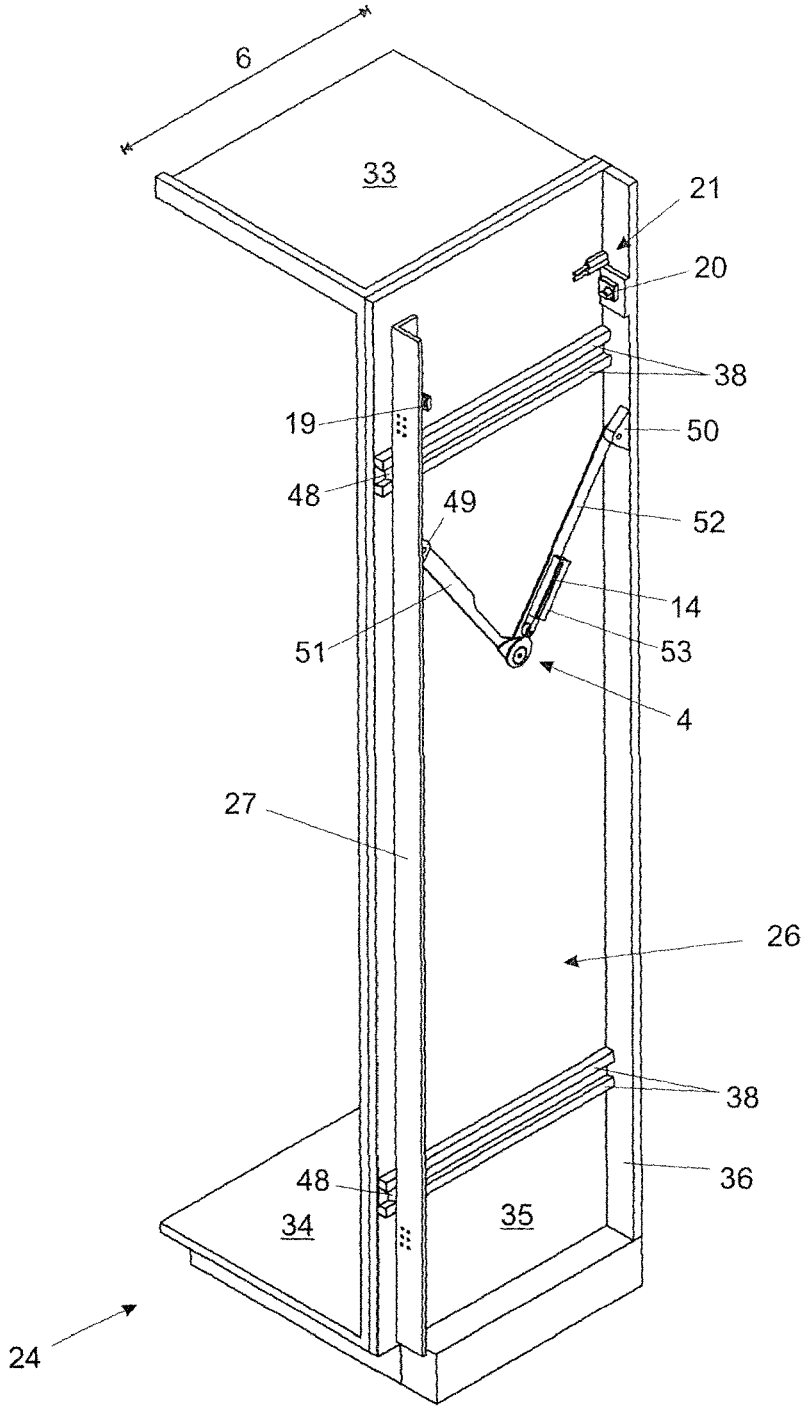

FIG. 9*a*) shows a partial section of the second item of furniture 24 in a perspective view. The basic structure of the item or furniture 24 corresponds to the item of furniture 23 shown in FIG. 1. Depicted are the cover plate 33, the base plate 34, the side wall 35 and the partial section 36 of the rear wall. The width of the side wall 35 defines the depth 6 of the cavity which arises by the limiting surfaces in the form of the side wall 35 of the partial section 36 of the rear wall and a further side wall which is oriented in a parallel relationship to the side wall 35. The further side wall is not shown in this and in the following figures in order to enable a free view to the arrangement according to the second embodiment of the invention. The furniture carcass (furniture body) is denoted with the reference number 26.

On the side wall 35, guide elements 38 are arranged for the guidance of sliders 48, the guide elements 38 are connected to a base fastening element 27 on which a furniture door is pivotally arranged.

Figure 12:
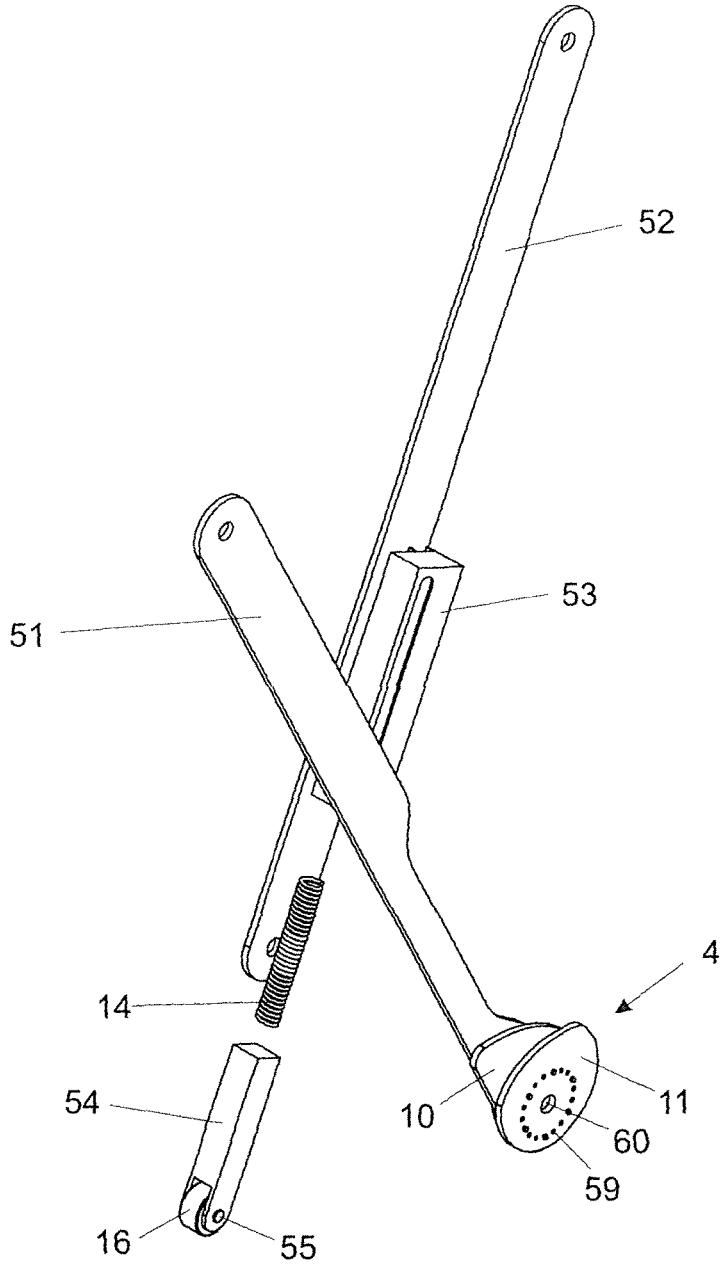
FIG. 12 includes an explosive view of the drive device according to the second embodiment.

The substantial components of the drive device according to the second embodiment are shown in the exploded view according to FIG. 12. The drive device includes a first lever 51, a first end of which is provided to be pivotally arranged on the base fastening element 27. On the other end of the lever 51, a control curve 4 is arranged which is composed of two segments 10 and 11 which are adjustable relative to one another. The adjustment is effected in a rotatable manner about the common pivoting axis 60. For fixing a defined position of the first segment 10 relative to the second segment 11, a plurality for fastening means in the form of holes 59 and corresponding threaded bores for accommodating screws are provided.

Pivotally arranged on the second end of the lever 51 is further a first end of a further lever 52, the second end of which is configured so as to be pivotally mounted to the furniture carcass 26.

It is generally to be noted that for the pivotable fastening of the levers 51 and 52 to the base fastening element 27 and the furniture carcass 26, respectively, wedge elements 49 and 50 are provided.

Upon a movement of the drive device, the relative position of the control curve 4 in relation to the lever 51 does not alter. On the contrast, the relative position of the control curve 4 in relation to the second lever 52 does vary.

Arranged on the second lever 52 is a housing 53 for accommodating an energy storage member in the form of a compression spring 14. Arranged within the housing 53, a sliding element 54 being acted upon by the energy storage member is displaceably arranged, the sliding element 54 has an end with a bearing 55 by which a control element 16 in the form of a roller is arranged. The control element 16 is pressurized by the force of the energy storage member against the control curve 4, more precisely on the upper side of the control curve 4 in the mounted position of the drive device.

Figure 9B:
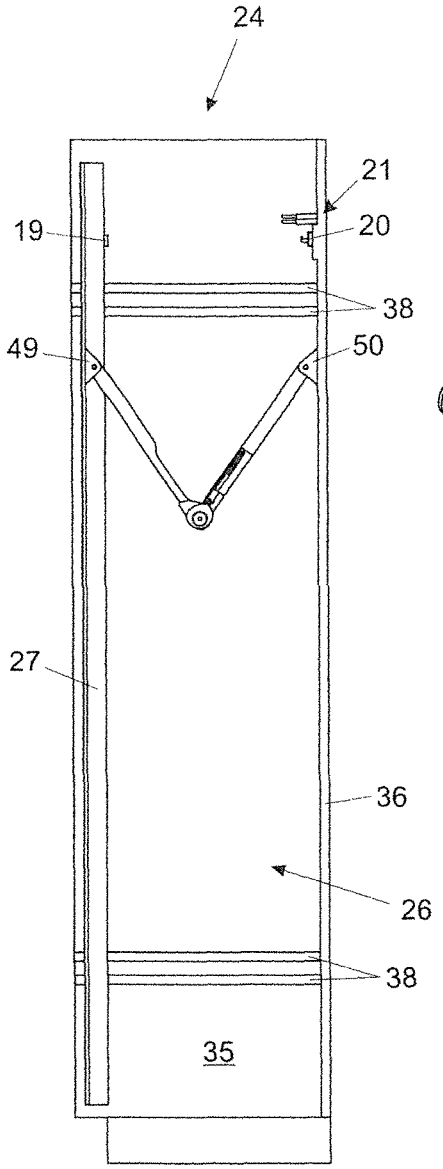
FIGS. 9*b*, 10*a*, and 11*a* show a side view.
Figure 9C:
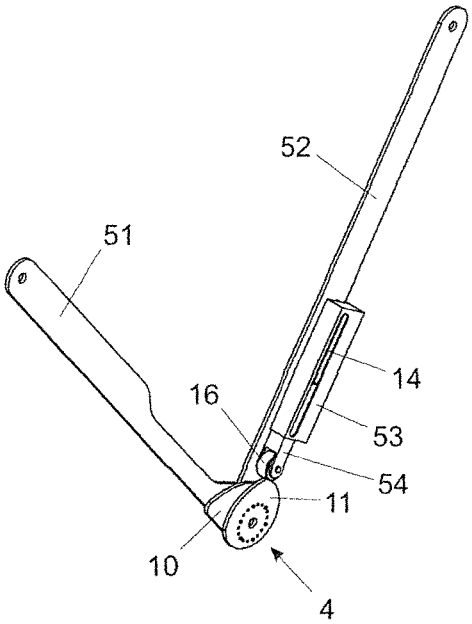
Figure 10A:
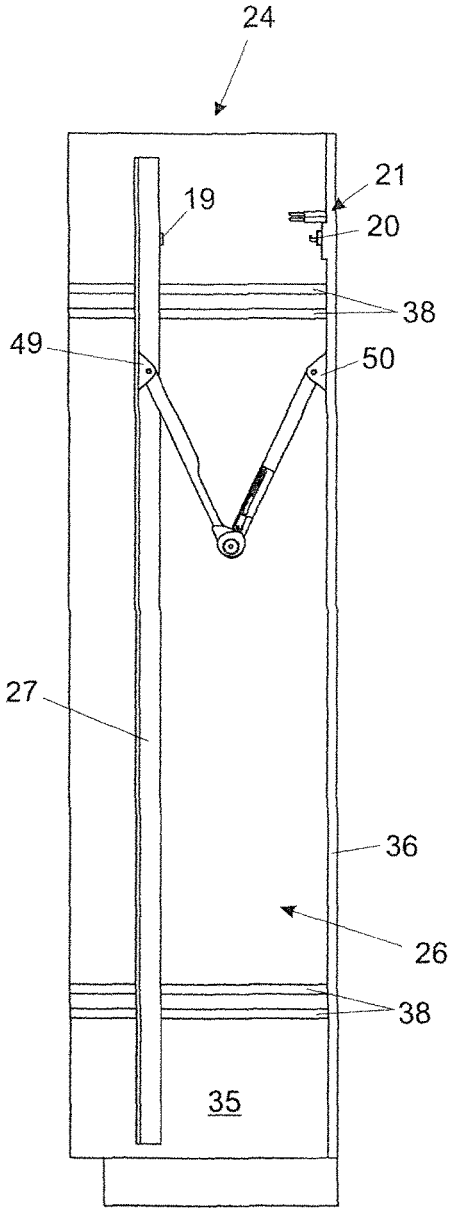
Figure 10B:
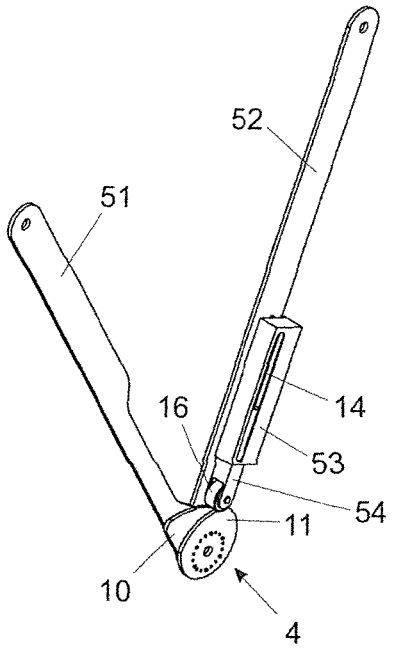
Figure 11A:
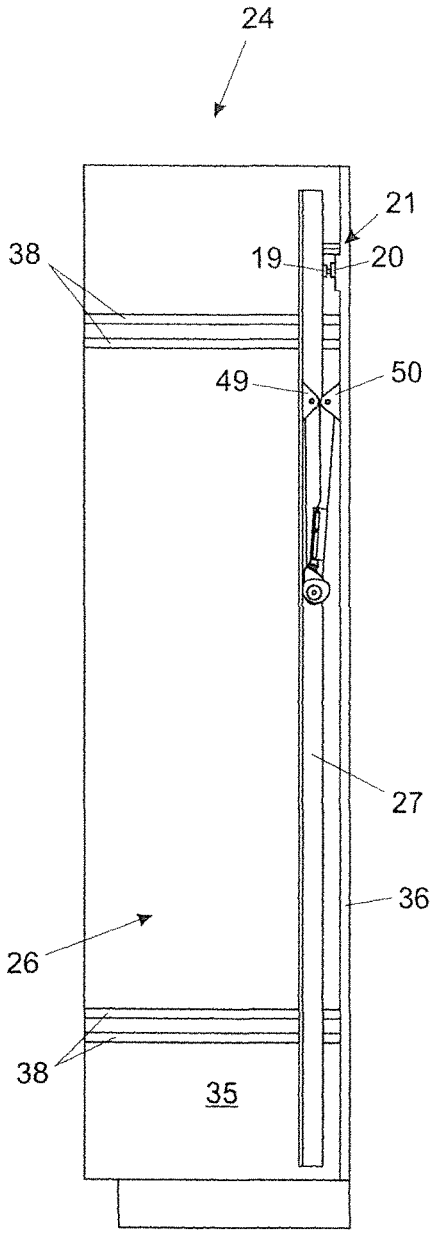
Figure 11B:
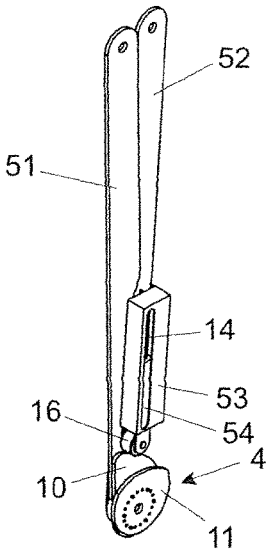

As shown in the sequence of FIGS. 9, 10 and 11, the control element 16, upon a movement of the furniture door 1 starting from the position outside of the cavity towards the fully countersunk position within the cavity, is subjected substantially to the same slopes and substantially runs through the same maxima and minima as it is the case with the first embodiment. This means that naturally also the movement sequence, upon a movement starting from the countersunk position within the cavity into the position outside of the cavity, operates in the same way as it is the case with the first embodiment. Also the functionality of the locking and the dampening of the furniture door immediately before reaching the fully countersunk position within the cavity operate in the same way as it is the case with the first embodiment.

As indicated above, a major difference, however, is that the control curve 4 can be adapted to different depths. FIG.

Figure 13A:
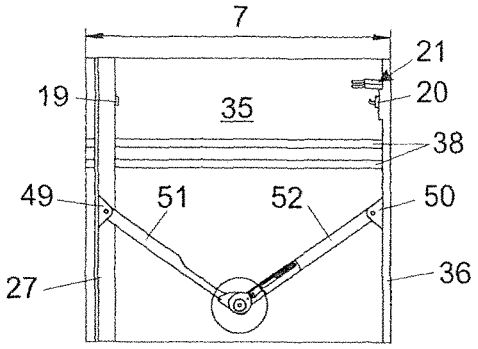
FIGS. 13*a* through 13*f* illustrate how the control curve according to the second embodiment can be adapted to different depths of the cavity, in which FIGS. 13*a*, 13*c*, and 13*e* each show a side view of a section of the item of furniture, and FIGS. 13*b*, 13*d*, and 13*f* each show an enlarged view of the control curve.
Figure 13B:
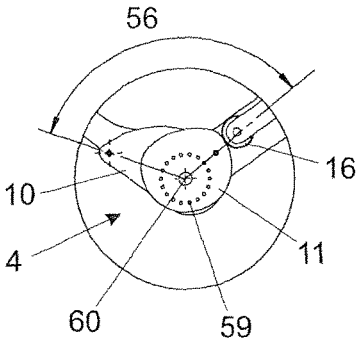
Figure 13C:
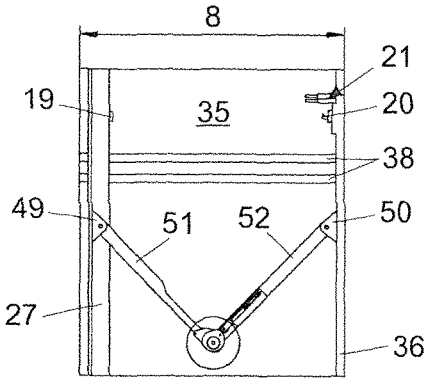
Figure 13D:
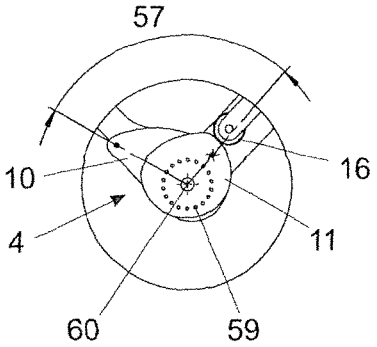
Figure 13E:
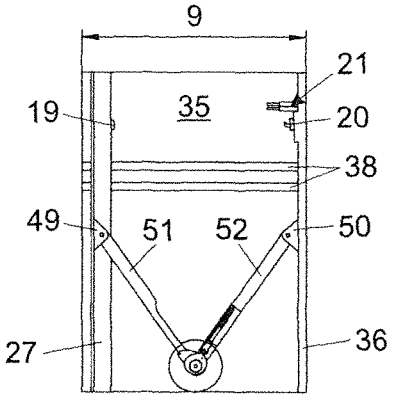
Figure 13F:
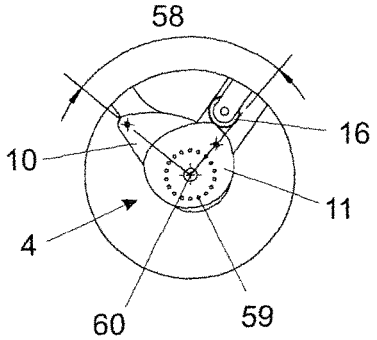

13*a*) through 13*f*) serve to illustrate this adaptation to different depths of the cavity and therewith to different depths of the item of furniture. In FIGS. 13*a*), 13*c*) and 13*e*), cavities with different depths 7, 8 and 9 are depicted. In order to ensure that the starting position and the end position of the control element 16 on the control curve 4 are in each case the same, the relative angular position 56, 57 and 58 of the segments 10 and 11 are adapted by the fastening elements 59, as it is shown in FIG. 13*b*), d) and f). The depths 7, 8 and 9 correspond, for example, to a depth of cavity of 750, 650 and 550 mm.

The invention claimed is:

1. An arrangement comprising:

a furniture door;

a furniture body having a cavity for accommodating the furniture door; and a mechanical drive device for moving the furniture door between a countersunk position within the cavity and a position outside of the cavity, wherein the drive device is configured so as to move the furniture door, starting from the countersunk position within the cavity into the position outside of the cavity, wherein the drive device includes:

a control curve for controlling the movement of the furniture door between the countersunk position within the cavity and the position outside of the cavity, an energy storage member, and a control element acted upon by the energy storage member, the control element being supported against the control curve by a force of the energy storage member.

2. The arrangement according to claim 1, wherein the drive device, the cavity, and the furniture door are configured such that, during the entire movement of the furniture door between the countersunk position within the cavity and the position outside of the cavity, the furniture door can be driven by the drive device.

3. The arrangement according to claim 1, wherein the control curve is adaptable to different depths of the cavity, the control curve being composed of two segments adjustable relative to one another to adapt the control curve to the different depths of the cavity.

4. The arrangement according to claim 1, wherein the energy storage member is in the form of at least one tension spring, and the control element is in the form of a roller.

5. The arrangement according to claim 4, wherein the control curve is stationarily arranged relative to the furniture door, and that the control element being acted upon by the energy storage member is coupled to the furniture door.

6. The arrangement according to claim 5, wherein the control curve is arranged on a limiting surface of the cavity, and the control element is coupled to the furniture door by a base fastening element of the furniture door.

7. The arrangement according to claim 4, wherein the control element is configured such that, in a mounting position of the drive device, the control element is supported against an upper side or against a lower side of the control curve.

8. The arrangement according to claim 4, wherein the control element is configured such that, in a mounting position of the drive device, the control element assumes a highest point or a lowest point of the control curve when the furniture door is located in the countersunk position within the cavity.

9. The arrangement according to claim 1, wherein the drive device is configured such that, when the furniture door is located in the countersunk position within the cavity, the drive device exerts a driving force to the furniture door.

10. The arrangement according to claim 1, wherein the drive device is configured such that, when the furniture door is located in the position outside of the cavity, the drive device exerts a restraining force to the furniture door.

11. The arrangement according to claim 1, wherein the arrangement includes a locking device for releasably locking the furniture door in the countersunk position within the cavity, wherein the locking device is unlockable.

12. The arrangement according to claim 11, wherein the locking device is unlockable by overpressing the furniture door towards an overpressing position lying behind the countersunk position.

13. The arrangement according to claim 1, further comprising a damping device, the damping device being configured to perform at least one of (i) dampening the movement of the furniture door immediately before reaching the countersunk position within the cavity, and (ii) dampening the movement of the furniture door immediately before reaching the position outside of the cavity.

14. An item of furniture comprising the arrangement of claim 1, wherein the item of furniture is a a cupboard including the furniture body, the cavity being formed in an edge region of the furniture body, and the item of furniture is configured to be closed by the furniture door.

15. The arrangement according to claim 1, wherein the furniture door is a fold-sliding-door, and the countersunk position is a fully countersunk position.

* * * * *